US006290170B1

(12) United States Patent
Suzuki et al.

(10) Patent No.: US 6,290,170 B1
(45) Date of Patent: Sep. 18, 2001

(54) STRIP GUIDING DEVICE

(75) Inventors: Tetsuo Suzuki; Hideki Shigematsu, both of Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/537,766

(22) Filed: Mar. 30, 2000

(30) Foreign Application Priority Data

Apr. 1, 1999 (JP) ..... 11/095396

(51) Int. Cl.[7] ..... B65H 23/04; B65H 57/04; B65H 57/06; G03B 1/44

(52) U.S. Cl. ..... 242/615.3; 226/196.1

(58) Field of Search ..... 242/615.3, 615.1; 226/196.1

(56) References Cited

U.S. PATENT DOCUMENTS 3,135,198 * 6/1964 Kingsley ..... 101/407
3,692,223 * 9/1972 Laigle et al. ..... 226/199
3,731,571 * 5/1973 Larson et al. ..... 83/420
3,854,647 * 12/1974 Mittendorf ..... 226/198
3,896,983 * 7/1975 Weinguni ..... 226/198
4,089,451 * 5/1978 Zlaikha ..... 226/136
4,846,387 * 7/1989 Mano ..... 226/199
5,150,996 * 9/1992 Thoroughman ..... 409/259
5,271,542 * 12/1993 Yamamoto ..... 226/199
5,360,152 * 11/1994 Matoushek ..... 266/199
6,135,386 * 10/2000 Garthaffner ..... 242/615.3

* cited by examiner

*Primary Examiner*—Donald P Walsh
*Assistant Examiner*—David A Jones
(74) *Attorney, Agent, or Firm*—Birch, Stewart, Kolasch & Birch, LLP

(57) ABSTRACT

A strip guiding device for guiding a strip longitudinally along a feed path has a limiting mechanism for limiting the strip transversely at opposite side edges thereof to cause the strip to pass through a predetermined position in the feed path. The limiting mechanism has a pair of abutment members having respective abutment surfaces for abutting against the side edges of the strip along the feed path. The abutment members are movable in first directions toward and away from the side edges of the strip, and normally urged by a spring assembly to move away from the strip. The limiting mechanism also has a pair of pressing members having respective slanted surfaces held in sliding contact with respective sliding surfaces of the abutment members remote from the abutment surfaces. The pressing members are movable in second directions transverse to the first directions. The pressing members press the abutment members toward the strip against the urging means by sliding contact of the slanted surfaces with the sliding surfaces in response to movement of the pressing members in one of the second directions. The limiting mechanism further includes a displacing mechanism for displacing the pressing members in the second directions to move the abutment members in the first directions.

6 Claims, 3 Drawing Sheets

STRIP GUIDING DEVICE

BACKGROUND OF THE INVENTION

1. Field of the Invention

The present invention relates to a guide device for guiding a strip along a feed path.

2. Description of the Related Art

For blanking workpieces of given shape out of a metal strip, it has been customary to supply the metal strip continuously along a feed path to a blanking apparatus. Generally, a metal strip having a given length is wound as a coil, and unwound from the coil and fed along the feed path to the blanking apparatus.

The blanking apparatus blanks desired workpieces out of the supplied strip at successive positions thereon. Along the feed path, the strip is transversely centered with respect to the feed path such that the central axis of the strip is aligned with the central axis of the feed path for thereby allowing the strip to be positioned easily at the machining position in the blanking apparatus.

The strip may be centered by a pair of limiting members such as guide plates or abutment pins disposed one on each side of the feed path for engaging respective longitudinal edges of the strip to positionally limit the strip. The distance between the limiting members are equalized to the width of the strip.

There are available various strip coils of different dimensions, so that some strips to be supplied to the blanking apparatus have different widths. If the width of a strip unwound from a coil is smaller than the distance between the limiting members, then the strip tends to be positionally displaced transversely, and centered inaccurately. Conversely, if the width of a strip unwound from a coil is smaller than the distance between the limiting members, then the strip cannot pass between the limiting members, and cannot be fed to the blanking apparatus.

As shown in FIGS. 4(*a*) and 4(*b*) of the accompanying drawings, there are known strips each having thinner longitudinal marginal edges X, Y and a workpiece forming region Z extending between the thinner longitudinal marginal edges X, Y. For feeding such strips, the transverse center of the workpiece forming region Z across its width "d" is used as a reference for centering the strips.

One problem with the stripes shown in FIGS. 4(*a*) and 4(*b*) is that the width "b" of one of the thinner longitudinal marginal edges X and the width "c" of the other thinner longitudinal marginal edge Y may possibly differ from each other. If the widths "b", "c" are not the same as each other, then the transverse center of the strip across its full width "a" is not aligned with the transverse center of the workpiece forming region Z across its width "d". As a result, these strips cannot be centered highly accurately in alignment with the feed path by the limiting members.

SUMMARY OF THE INVENTION

It is therefore an object of the present invention to provide a strip guiding device which is capable of centering a strip quickly and highly accurately along a feed path.

To achieve the above object, there is provided in accordance with the present invention a guiding device for guiding a strip longitudinally along a feed path, comprising limiting means disposed in the feed path, for limiting the strip transversely at opposite side edges thereof to cause the strip to pass through a predetermined position in the feed path.

The limiting means has a pair of abutment members having respective abutment surfaces for abutting against the side edges of the strip along the feed path, the abutment members being movable in first directions toward and away from the side edges of the strip, and urging means for normally urging the abutment members away from the strip. The limiting means also has a pair of pressing members having respective slanted surfaces held in sliding contact with respective sliding surfaces of the abutment members remote from the abutment surfaces. The pressing members are movable in second directions transverse to the first directions. The pressing members press the abutment members toward the strip against the urging means by sliding contact of the slanted surfaces with the sliding surfaces in response to movement of the pressing members in one of the second directions. The limiting means further includes displacing means for displacing the pressing members in the second directions to move the abutment members in the first directions.

When the pressing members are displaced in the second directions by the displacing means, the slanted surfaces of the pressing members slidingly contact the sliding surfaces of the abutment members. The abutment members are moved toward the strip against the bias of the urging means until the abutment members abut against the respective side edges of the strip. The guiding device can thus transversely limit the strip at its side edges to cause the strip to pass through the predetermined position in the feed path irrespective of the transverse dimension of the strip.

The limiting means preferably comprises adjusting means for moving at least one of the pressing members in the second directions with respect to the displacing means to adjust a distance by which the abutment members are moved, for thereby causing a predetermined position on the strip to pass through the predetermined position in the feed path.

The adjusting means can displace one of the pressing members in the second directions to move the abutment members by different distances. The guiding device can thus limit the strip so that any desired transverse position on the strip can pass through the predetermined position in the feed path.

The pressing members are shaped to move the abutment members by the same distance by sliding contact of the slanted surfaces of the pressing members with the sliding surfaces of the abutment members in response to movement of the pressing members in one of the second directions by the same distance. The displacing means displaces the pressing members in unison with each other in one of the second directions to move the abutment members by the same distance for thereby causing a transverse center of the strip to pass through a transverse center of the feed path.

The slanted surfaces of the pressing members which have been moved in unison with each other in one of the second directions slidingly contact the sliding surfaces of the abutment members to move the abutment members simultaneously by the same distance. When the abutment members abut against the respective side edges of the strip, the transverse center of the strip is aligned with the transverse center of the feed path. Consequently, the strip can be centered with high accuracy regardless of the transverse dimension of the strip.

The strip may have a predetermined transverse region as a workpiece forming region for forming workpieces therefrom, and the limiting means may comprise adjusting means for moving at least one of the pressing members in the second directions with respect to the displacing means to adjust a distance by which the abutment members are moved, for thereby causing a center of the workpiece forming region of the strip to pass through a transverse center of the feed path.

Some strips which have workpiece forming regions may have their transverse center out of positional alignment with the center of the workpiece forming region. When such a strip is fed along the feed path, at least one of the pressing members is displaced in the second directions by the adjusting means depending on the transverse dimensions of the side edges of the strip, and thereafter the abutment members are moved the same distance by the displacing means. In this manner, the transverse center of the workpiece forming region can easily be brought into alignment with the transverse center of the feed path.

The guiding device may further comprise a base plate, the abutment members being supported on the base plate for movement toward and away from the strip, and a joint block positioned for movement toward and away from the base plate, the pressing members being coupled to the joint block for movement in the second directions. The displacing means may comprise a threaded member, and joint block may be coupled for movement toward and away from the base plate. The threaded member may have an end rotatably supported by the joint block and an opposite end threaded in the base plate. When the threaded member is turned about its own axis, the joint block causes the pressing members to move in unison with each other in the second directions.

With this arrangement, when the threaded member is turned about its own axis, the pressing members can be moved in unison with each other in the second directions. Since the end of the threaded member is threaded in the base plate, the pressing members can be kept reliably in a desired position. The threaded member can be turned about its own axis to progressively vary the depth by which the threaded member is threaded in the base plate for thereby causing the pressing members to move the abutment members with high accuracy.

At least one of the pressing members may have an end coupled to the joint block through the threaded member. When the threaded member is turned about its own axis, the at least one of the pressing members is displaced along the sliding surface of the corresponding one of the abutment members.

Therefore, the threaded member can be turned about its own axis to adjust the distance between the joint block and the pressing member to move at least one of the abutment members toward or away from the strip. When the threaded member is turned to adjust the distance by which the abutment member is moved for thereby causing a center of the workpiece forming region of the strip to pass through a transverse center of the feed path, the transverse center of the workpiece forming region can accurately be aligned with the transverse center of the feed path no matter where the transverse center of the workpiece forming region may be positioned across the strip.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

FIG. 4(*b*) is a transverse cross-sectional view of another strip.

DETAILED DESCRIPTION OF THE PREFERRED EMBODIMENT

Figure 1:
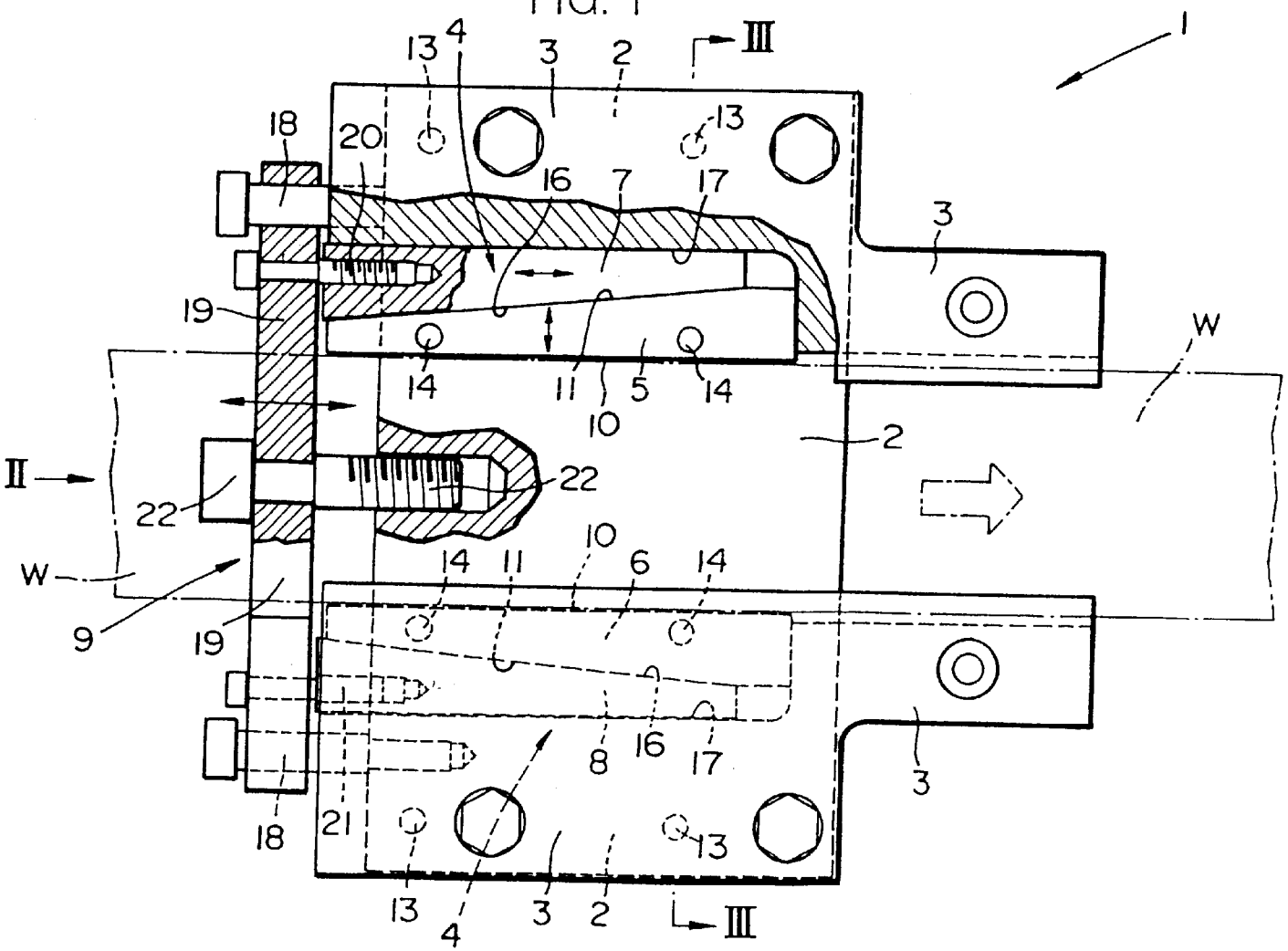
FIG. 1 is a plan view, partly in cross section, of a strip guiding device according to the present invention.

As shown in FIG. 1, a strip guiding device 1 according to the present invention is disposed on a feed path (not shown) for feeding a metal strip W to a blanking apparatus (not shown).

Figure 2:
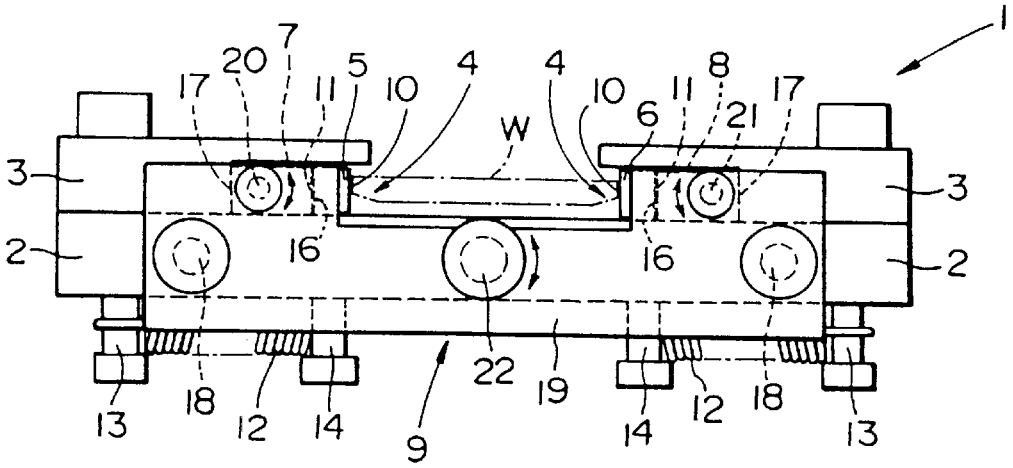
FIG. 2 is an elevational view of the strip guiding device as viewed in the direction indicated by the arrow II in FIG. 1.
Figure 3:
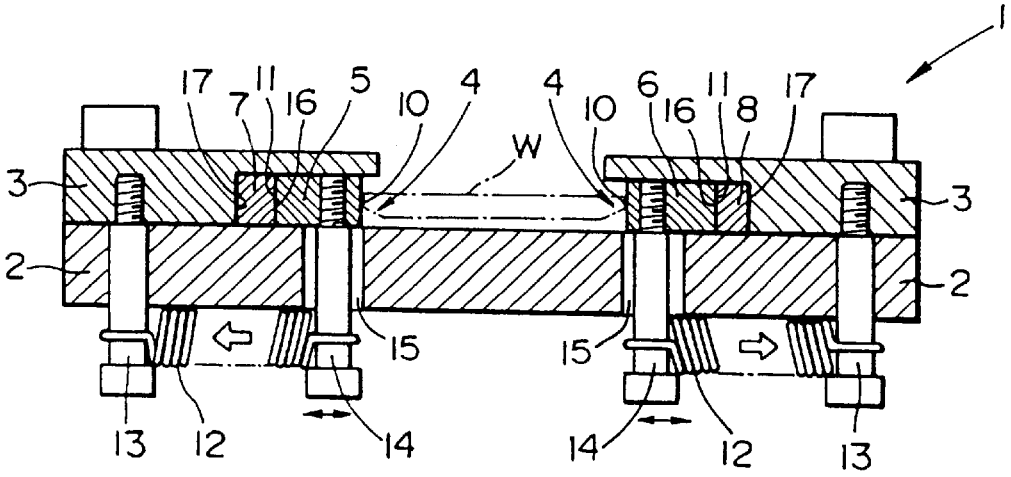
FIG. 3 is a cross-sectional view taken along line III —III of FIG. 1.

As shown in FIGS. 1 through 3, the strip guiding device 1 comprises a base plate 2 disposed below the strip W to be fed, a pair of transversely spaced frames 3 mounted on the base plate 2 and fastened thereto at opposite sides of the strip W, and a limiting means 4 supported by the base plate 2 and the frames 3.

The limiting means 4 comprises a pair of abutment members 5, 6 transversely movable toward and away from the strip W, a pair of sliders (pressing members) 7, 8 longitudinally movable horizontally along the feed path, i.e., the direction indicated by the blank arrow (see FIG. 1), and a displacing means 9 for displacing the sliders 7, 8.

The abutment members 5, 6 have respective abutment surfaces 10 extending along the feed path for confronting and engaging the strip W. The abutment members 5, 6 also have respective sliding surfaces 11 remote from the abutment surfaces 10 and slanted progressively away from the strip W downstream along the feed path in the direction indicated by the blank arrow. The sliders 7, 8 are slidably held in abutment against the sliding surfaces 11. As shown in FIG. 3, the abutment members 5, 6 are normally urged to move away from the strip W into pressed engagement with the respective sliders 7, 8 by a plurality of tension springs (urging means) 12. The tension springs 12 have ends retained by support pins 13 fixed to the base plate 2 and the frames 3 and joint pins 14 connected to the abutment members 5, 6. The joint pins 14 are movable in respective oblong holes 15 defined in the base plate 2 in directions in which the tension springs 12 can be extended and contracted.

As shown in FIG. 1, the sliders 7, 8 have respective slanted surfaces 16 that are held in contact with the sliding surfaces 11 of the respective abutment members 5, 6. The slanted surfaces 16 are inclined complementarily to the sliding surfaces 16 such that the slanted surfaces 16 are slanted progressively away from the strip W downstream along the feed path in the direction indicated by the blank arrow. The sliders 7, 8 have respective opposite surfaces remote from the slanted surfaces 16 and slidably engaged by respective inner walls of the frames 3.

As shown in FIGS. 1 and 2, the displacing means 9 has a joint block 19 slidable along a pair of guide rods 18 which extends horizontally from the base plate 2 parallel to the feed path. The sliders 7, 8 are coupled at upstream ends thereof to the joint block 19 by respective adjustment screws (adjustment means) 20, 21. A manipulating bolt 22 (threaded member) has an end portion rotatably, but axially immovably, inserted through and supported by the joint block 19 and a tip end portion threaded into the base plate 2. When the manipulating bolt 22 is manually turned about its own axis, the manipulating bolt 22 is axially displaced along the feed path, thus moving the joint block 19 along the guide rods 18. Since the sliders 7, 8 are connected to the joint block 19, the sliders 7, 8 are also moved and hence their slanted surfaces 16 are moved along the sliding surfaces 11 of the abutment members 5, 6. As a result, the abutment members 5, 6 are transversely moved toward or away from each other depending on the direction in which the sliders 7, 8 are moved.

As shown in FIG. 1, the adjustment screws 20, 21 are threaded in the respective upstream ends of the sliders 7, 8, thus coupling the joint block 19 to the sliders 7, 8. Therefore, when the adjustment screws 20, 21 are turned about their own axes, the sliders 7, 8 can individually be moved axially. Specifically, rotation of the adjustment screws 20, 21 can adjust the distances between the sliders 7, 8 and the joint block 22. For example, before the manipulating bolt 22 is turned, the adjustment screw 21 may be turned to move the slider 8 in the direction in which the strip W is fed, for thereby displace the abutment member 6 a certain distance transversely into the feed path.

Figure 4A:
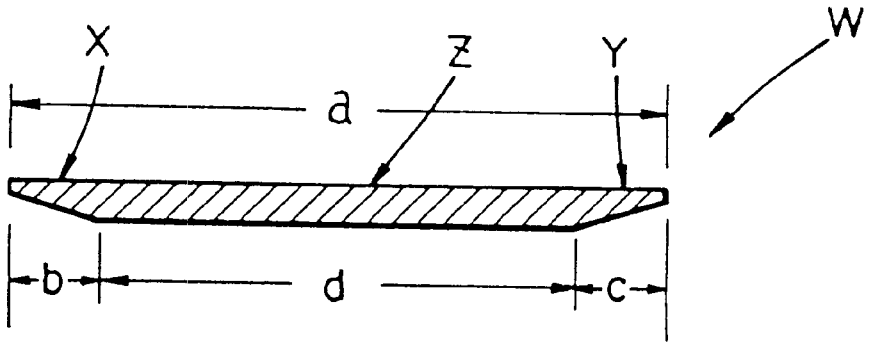
FIG. 4(*a*) is a transverse cross-sectional view of a strip.
Figure 4B:
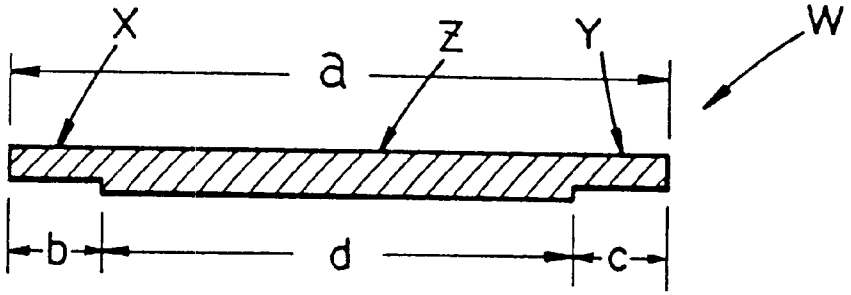

Operation of the strip guiding device 1 will be described below with reference to FIGS. 4(*a*) and 4(*b*). The strip W, which may be of the cross-sectional shape shown in FIG. 4(*a*) or 4(*b*), is fed along the feed path that is associated with the strip guiding device 1. The strip guiding device 1 is applicable to the strip W shown in FIG. 4(*a*) and the strip W shown in FIG. 4(*b*). Each of the strips W shown in FIGS. 4(*a*) and 4(*b*) has thinner longitudinal marginal edges X, Y and a workpiece forming region Z extending between the thinner longitudinal marginal edges X, Y. The workpiece forming region Z may be machined by a blanking apparatus or the like (not shown).

If the width "b" of the thinner longitudinal marginal edge X of the strip W is equal to the width "b" of the thinner longitudinal marginal edge Y thereof, then the adjustment screws 20, 21 are turned to positionally adjust the abutment members 5, 6 for equalizing the distances of the abutment members 5, 6 from the transverse center of the feed path. Then, the manipulating bolt 22 is turned to displace the abutment members 5, 6 away from each other by a distance which is larger than the width "a" of the strip W to be fed.

When the strip W is fed along the feed path, the manipulating bolt 22 is turned to displace the abutment members 5, 6 toward the strip W. The distances by which the abutment members 5, 6 are displaced by the sliders 7, 8 are equal to each other. When the abutment members 5, 6 abut against the opposite side edges of the strip W, the transverse center of the strip W is aligned with the transverse center of the feed path. Therefore, the opposite side edges of the strip W are engaged and limited by the respective abutment members 5, 6, and the strip W can be fed accurately along the feed path.

If the width "b" of the thinner longitudinal marginal edge X of the strip W is different from the width "b" of the thinner longitudinal marginal edge Y thereof, then the transverse center of the strip W is held out of positional alignment with the transverse center of the workpiece forming region Z. For example, if the width "b" of the thinner longitudinal marginal edge X is greater than the width "b" of the thinner longitudinal marginal edge Y in FIG. 4(*a*) or 4(*b*), then the transverse center of the workpiece forming region Z is displaced from the transverse center of the strip W toward the thinner longitudinal marginal edge Y. In this case, the abutment member 6 (the lower abutment member in FIG. 1) that is held in contact with the thinner longitudinal marginal edge Y, whose width "c" is smaller than the width "b" of the thinner longitudinal marginal edge X, is displaced by the adjustment screw 21 into the feed path by a distance which is equal to the difference between the widths "b", "c" of the thinner longitudinal marginal edges X, Y. Thereafter, when the strip W is fed along the feed path, the manipulating bolt 22 is turned to displace the abutment members 5, 6 toward the strip W. At the time the abutment members 5, 6 abut against the opposite side edges of the strip W, the transverse center of the workpiece forming region Z is aligned with the transverse center of the feed path. The opposite side edges of the strip W are engaged and limited by the respective abutment members 5, 6 at respective positions depending on the difference between the widths "b", "c" of the thinner longitudinal marginal edges X, Y. The strip W is now fed accurately along the feed path with the workpiece forming region Z as a positioning reference.

In the illustrated embodiment, as shown in FIG. 1, the slanted surfaces 16 of the sliders 7, 8 are slanted progressively away from the strip W downstream along the feed path in the direction indicated by the blank arrow, and the sliding surfaces 11 of the abutment members 5, 6 are slanted complementarily to the slanted surfaces 16. With this arrangement, when the manipulating bolt 22 is turned to displace the sliders 7, 8 downstream along the feed path, the abutment members 5, 6 are brought into abutment against the strip W. However, the sliders 7, 8 may have slanted surfaces which are slanted progressively toward the strip W downstream along the feed path in the direction indicated by the blank arrow, and the sliding surfaces 11 of the abutment members 5, 6 may be slanted complementarily to the slanted surfaces 16. With this alternative arrangement, when the manipulating bolt 22 is turned to displace the sliders 7, 8 upstream along the feed path, the abutment members 5, 6 are brought into abutment against the strip W.

While the manipulating bolt 22 is manually operated in the above embodiment, the present invention is not limited to the illustrated arrangement. The manipulating bolt 22 may be turned by an actuator or the like, and the manipulating bolt 22 may be replaced with a cylinder for axially displacing the joint block 19.

Although a certain preferred embodiment of the present invention has been shown and described in detail, it should be understood that various changes and modifications may be made therein without departing from the scope of the appended claims.

What is claimed is:

1. A guiding device for guiding a strip longitudinally along a feed path, comprising:

limiting means disposed in said feed path, for limiting the strip transversely at opposite side edges thereof to cause said strip to pass through a predetermined position in said feed path;

said limiting means comprising:

a pair of abutment members having respective abutment surfaces for abutting against the side edges of said strip along said feed path, said abutment members being movable in first directions toward and away from said side edges of said strip;

urging means for normally urging said abutment members away from the strip;

a pair of pressing members having respective slanted surfaces held in sliding contact with respective sliding surfaces of said abutment members remote from said abutment surfaces, said pressing members being movable in second directions transverse to said first directions, the arrangement being such that said pressing members press said abutment members toward said strip against said urging means by sliding contact of said slanted surfaces with said sliding surfaces in response to movement of said pressing members in one of said second directions; and displacing means for displacing said pressing members in said second directions to move said abutment members in said first directions.

2. A guiding device according to claim 1, wherein said limiting means comprises adjusting means for moving at least one of said pressing members in said second directions with respect to said displacing means to adjust a distance by which said abutment members are moved, for thereby causing a predetermined position on said strip to pass through said predetermined position in said feed path.

3. A guiding device according to claim 1, wherein said pressing members are shaped to move said abutment members by the same distance by sliding contact of the slanted surfaces of the pressing members with the sliding surfaces of the abutment members in response to movement of said pressing members in one of said second directions by the same distance, said displacing means comprising means for displacing said pressing members in unison with each other in one of said second directions to move said abutment members by the same distance for thereby causing a transverse center of the strip to pass through a transverse center of the feed path.

4. A guiding device according to claim 3, wherein said strip has a predetermined transverse region as a workpiece forming region for forming workpieces therefrom, said limiting means comprising adjusting means for moving at least one of said pressing members in said second directions with respect to said displacing means to adjust a distance by which said abutment members are moved, for thereby causing a center of said workpiece forming region of said strip to pass through a transverse center of the feed path.

5. A guiding device according to claim 1, further comprising a base plate, said abutment members being supported on said base plate for movement toward and away from said strip, and a joint block positioned for movement toward and away from said base plate, said pressing members being coupled to said joint block for movement in said second directions, said displacing means comprising a threaded member, said joint block being coupled for movement toward and away from said base plate, said threaded member having an end rotatably supported by said joint block and an opposite end threaded in said base plate, the arrangement being such that when said threaded member is turned about its own axis, said joint block causes said pressing members to move in unison with each other in said second directions.

6. A guiding device according to claim 5, wherein said strip has a predetermined transverse region as a workpiece forming region for forming workpieces therefrom, at least one of said pressing members having an end coupled to said joint block through said threaded member, the arrangement being such that when said threaded member is turned about its own axis, said at least one of said pressing members is displaced along the sliding surface of the corresponding one of said abutment members to adjust a distance by which said abutment member is moved, for thereby causing a center of said workpiece forming region of said strip to pass through a transverse center of the feed path.

* * * * *